United States Patent [19]

Hux et al.

[11] 4,007,793

[45] Feb. 15, 1977

[54] FIRE FIGHTING APPARATUS

[76] Inventors: Fred M. Hux, 1816 Lewis St.; Thomas Hudson, 300 Howard Ave., both of Tarboro, N.C. 27886

[22] Filed: Aug. 25, 1975

[21] Appl. No.: 607,851

[52] U.S. Cl. ..... 169/25; 239/161; 239/166; 239/172; 239/578; 239/587

[51] Int. Cl.[2] ..... A62C 27/00; B05B 1/30; B05B 1/12

[58] Field of Search ..... 169/24, 25; 239/159–166, 169, 170, 172, 175, 176, 587, 583, 578

[56] References Cited

UNITED STATES PATENTS

| | | | |
|---|---|---|---|
| 1,835,132 | 12/1931 | Anania | 169/25 X |
| 2,834,416 | 5/1958 | Becker | 239/587 X |
| 2,965,304 | 12/1960 | Krause | 239/161 X |
| 3,206,126 | 9/1965 | Thompson | 239/578 X |
| 3,346,052 | 10/1967 | Moore et al. | 169/25 |
| 3,554,452 | 1/1971 | Davidson et al. | 169/24 X |
| 3,599,722 | 8/1961 | Davidson et al. | 169/25 X |
| 3,604,627 | 9/1971 | Miscovich et al. | 239/166 |
| 3,675,721 | 7/1972 | Davidson et al. | 169/24 |
| 3,770,062 | 11/1973 | Riggs | 169/25 X |
| 3,915,389 | 10/1975 | Updegrave | 239/587 X |

*Primary Examiner*—Robert S. Ward, Jr.
*Attorney, Agent, or Firm*—A. Yates Dowell, Jr.

[57] ABSTRACT

Apparatus for fighting fires including a plurality of nozzles mounted on an aerial ladder and supplied with water under pressure which is directed onto the fire. Each of the nozzles is controlled from a remote position in a manner such that the direction of the water and the intensity of the water being discharged can be altered as desired.

6 Claims, 9 Drawing Figures

FIRE FIGHTING APPARATUS

BACKGROUND OF THE INVENTION

1. Field of the Invention

This invention relates generally to apparatus for extinguishing flames and relates particularly to a fire fighting system including one or more remotely controlled nozzles mounted on an aerial ladder of a fire truck.

2. Description of the Prior Art

Heretofore, fire fighting vehicles of the so-called "Hook and Ladder" type trucks have been provided with aerial ladders which were pivotally mounted on a swivel base and were adapted to be raised and lowered, extended and retracted, and swung about a vertical axis from a control pedestal on the base which was selectively operated by a fireman. Ordinarily, one or more additional firemen would climb the ladder with hoses to direct water under pressure onto the fire. By twisting a portion of the nozzle, or by operating a mechanical linkage, the fireman could adjust the intensity of the water being discharged from a steady stream to a fog. However, the amount of water being discharged, calculated in water pressure and gallons per minute, was limited by the physical ability of the fireman to control the nozzle. Since a fireman on an aerial ladder normally could not control the nozzle at pressures in excess of 60 to 80 p.s.i.g., the water could not be projected to great distances and, accordingly, it was necessary to locate the ladder close to the fire which increased the danger to the fireman.

To decrease the fireman's peril, as well as to increase the pressure and quantity of water passing through the nozzle, a manually controlled swivel type nozzle has been mounted on the end of the ladder; however, controlling the direction of the nozzle has been fatiguing to the fireman so that it was necessary to alternate firemen frequently. Also, the presence of a fireman on the ladder while the ladder was being extended and retracted has been dangerous since many fireman have been injured including by having toes and other portions of their bodies multilated by the moving sections of the ladder.

Some efforts have been made to provide a nozzle on the end of an aerial ladder and to provide apparatus for controlling the nozzle from a remote location. However, most of these structures have included chain and sprocket or rack and pinion connections between the nozzle control mechanism and the power plant for moving the same. These structures have not been satisfactory since they have required excessive power so that in many cases it has been necessary to provide a portable generator just to supply electrical energy to the nozzle operating apparatus. Also, since the nozzles have been mounted on the end of the ladder, they have been subjected to severe vibration and shaking particularly while the fire truck was speeding to a fire or while returning to the station. The malfunction of the remotely controlled nozzles has been so prevalent that many ladder companies have removed the nozzles from the ladder as long as the truck was moving and have installed the nozzles after the truck arrived at the fire. Obviously this has delayed the fighting of the fire during the crucial first few minutes after the equipment arrived at the scene of the fire. Some examples of the prior art are embodied in the following U.S. Pat. Nos.: 1,835,132 — Anania; 2,593,921 — Robinson; 2,698,664 — Freeman; 3,010,519 — Gillespie; 3,599,722 — Davidson; 3,762,478 — Cummins; and 3,770,062 — Riggs.

SUMMARY OF THE INVENTION

This invention is embodied in a fire fighting apparatus and system in which one or more nozzles are mounted on an aerial ladder and each of such nozzles is controlled from a remote location to direct water passing through the nozzle in a desired direction and to regulate the intensity and distance carrying capacity of the water by changing the water flow from a narrow stream to a fog. In the present system, an upper nozzle having a 500 gallon per minute capacity is mounted on the outer end of the upper telescoping section of an aerial ladder and such upper nozzle normally is swingably mounted for up-and-down movement generally along the plane of the axis of the ladder. A lower nozzle having a 1000 gallon per minute capacity is mounted on the outer end of the lower section of the aerial ladder and is swingably mounted for up-and-down movement generally along the plane of the axis of the ladder and also is swingably mounted for back-and-forth movement across the plane of the axis of the ladder. Each of the nozzles is controlled by one or more fluid motors which in turn are driven by electric motors supplied with energy from the battery of the truck and are controlled from a remote position by switches mounted on the control pedestal of the ladder.

It is an object of the invention to provide a fire fighting apparatus and system including at least one nozzle mounted on an aerial ladder in spaced relationship to the base thereof and such nozzle is selectively controlled from a remote position to direct water discharged therefrom to a desired location.

Another object of the invention is to provide a fire fighting apparatus and system in which a plurality of nozzles are mounted on an aerial ladder and each of such nozzles is independently selectively controlled so that they may direct the flow of water onto the same portion of a fire or onto different portions.

DESCRIPTION OF THE PREFERRED EMBODIMENT

Figure 1:
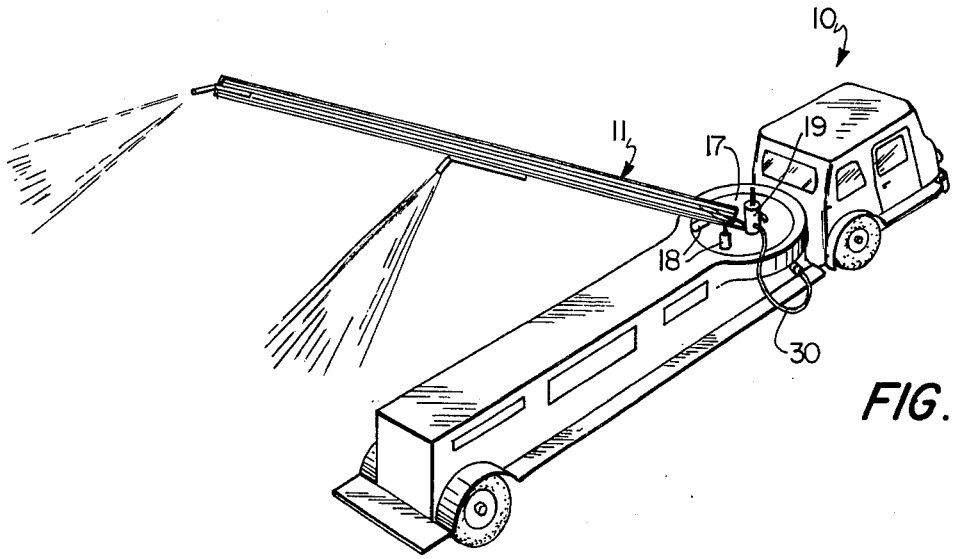
FIG. 1 is a perspective of a fire truck having an aerial ladder and illustrating one embodiment of the present invention.

With continued reference to the drawings, a fire truck 10 is provided with an aerial ladder 11 having lower, intermediate, and upper sections 12, 13 and 14, respectively. The inner end of the lower section 12 is swingably mounted about pivot pins 15 carried by ears 16 mounted on a rotatable base member 17. One or more fluid cylinders 18 are mounted on the base member 17 and have piston rods connected to the ladder for raising and lowering the same. A pedestal 19 having one or more operating levers 20 is mounted on the rotatable base member 17 and such levers control the angularity of the ladder, the telescoping of the ladder sections, and the rotation of the base member. Each section of the telescoping aerial ladder includes a plurality of equally spaced rungs 21 by which a fireman climbs the ladder. Also, the upper and intermediate sections 14 and 13, respectively, are movably mounted on the lower section 12 in a manner (not shown) such that the upper section is extended and retracted at substantially twice the speed of the intermediate section. The structure thus far described is conventional in the art and forms no part of the invention.

Figure 2:
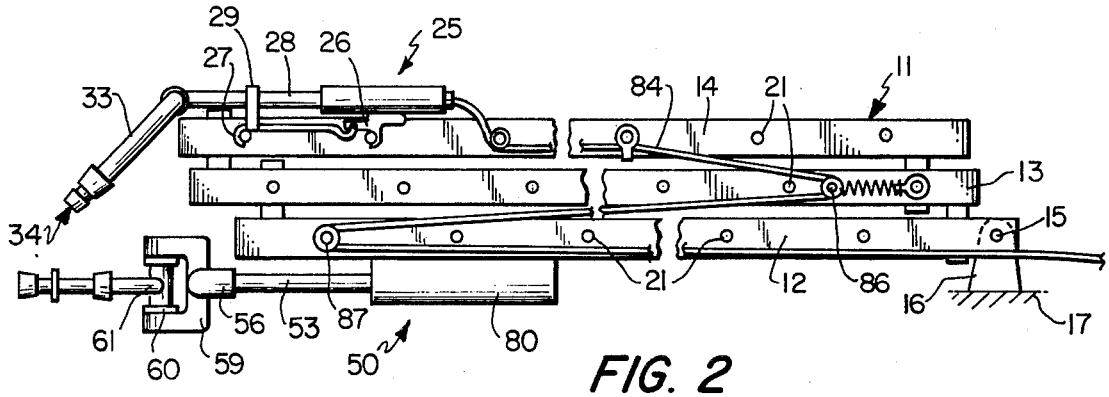
FIG. 2 is a fragmentary side elevation of a telescoping aerial ladder with a pair of nozzles mounted thereon.
Figure 6:
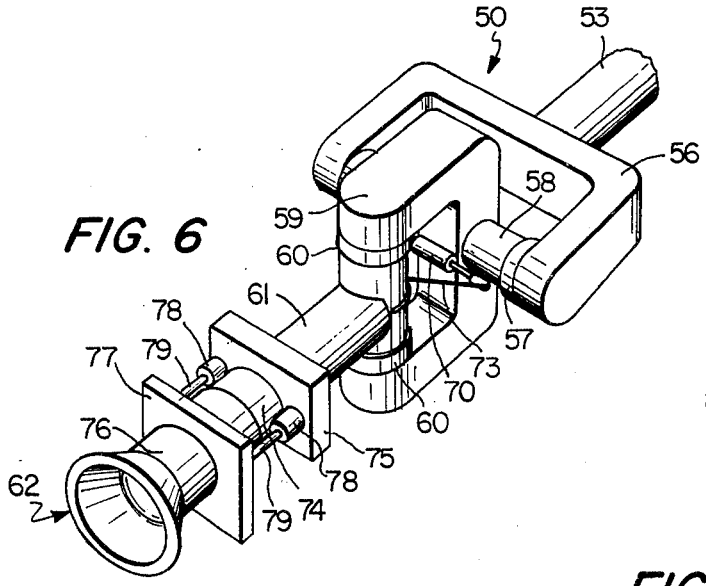
FIG. 6 is an enlarged perspective thereof.
Figure 3:
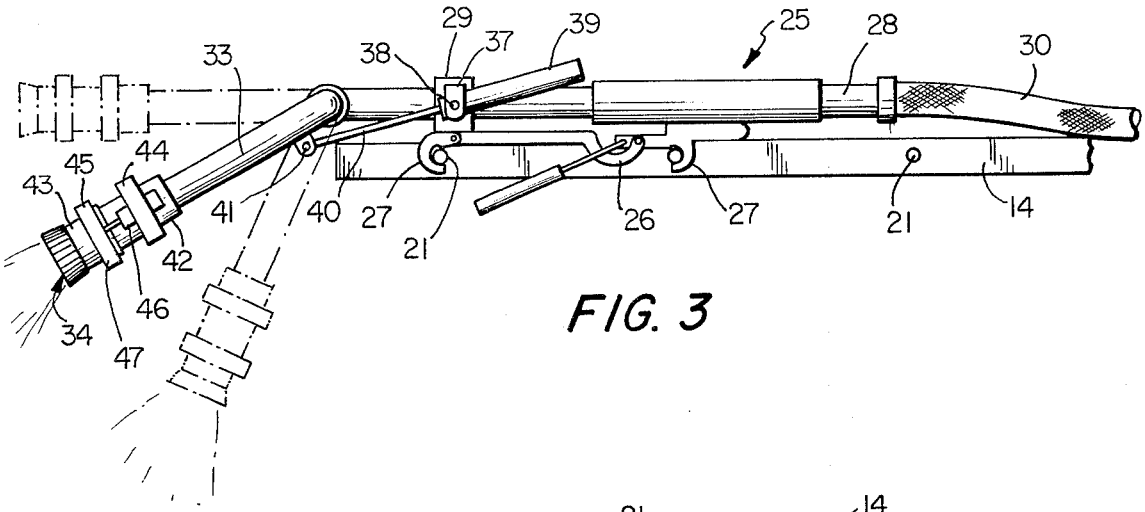
FIG. 3 is an enlarged side elevation of the upper nozzle.
Figure 4:
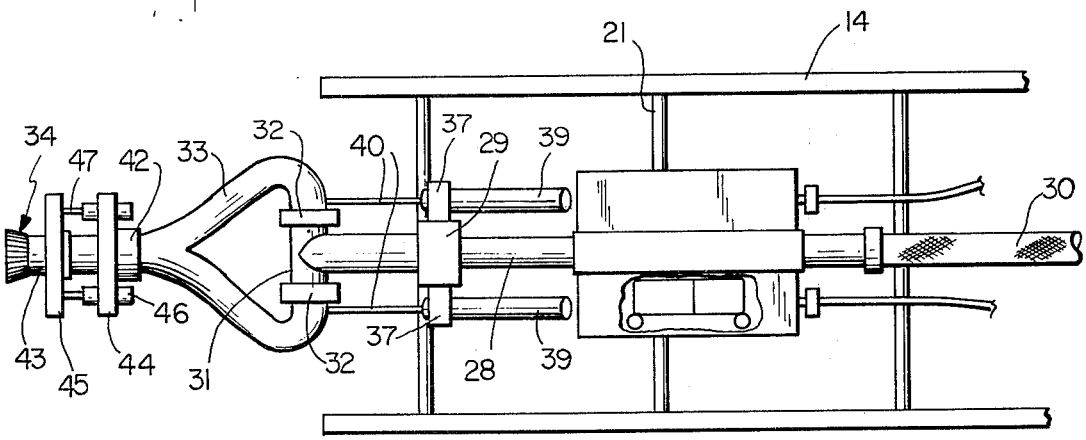
FIG. 4 is a top plan view thereof.
Figure 5:
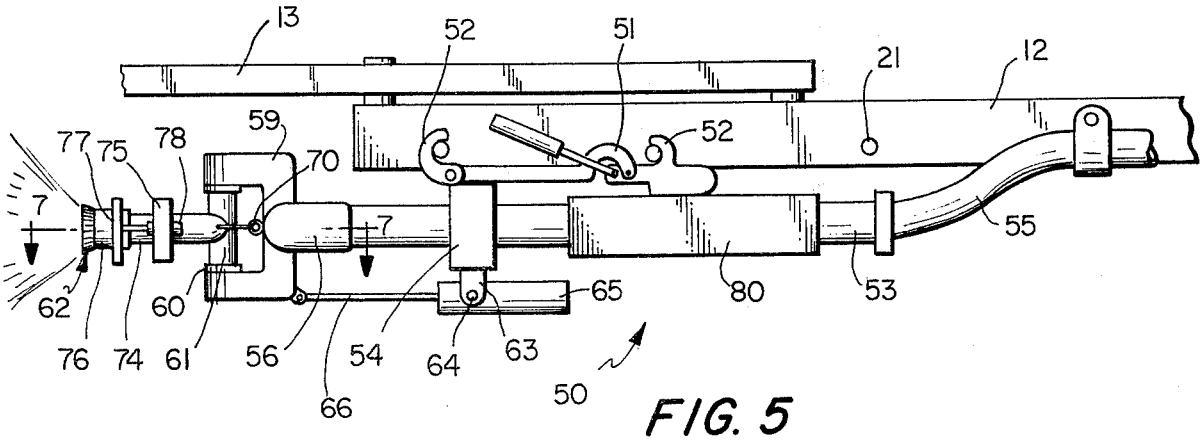
FIG. 5 is an enlarged side elevation of the lower nozzle.
Figure 7:
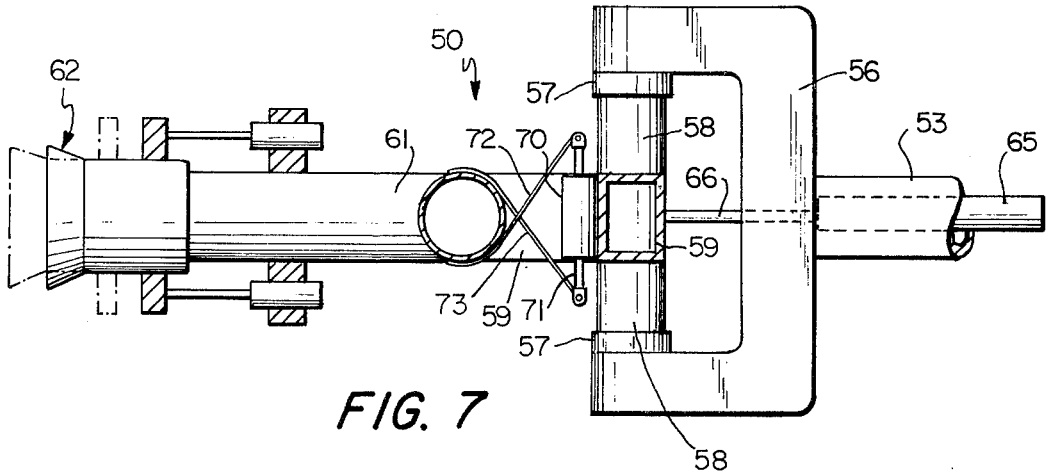
FIG. 7 is an enlarged section on the line 7—7 of FIG. 5.

With particular reference to FIGS. 2–4, an upper nozzle assembly 25 is mounted on the outer end of the upper section 14 of the ladder by means of an articulated frame 26 forming an over-center toggle type clamp. Each portion of such frame has a hook member 27 of a size to receive and engage a rung 21 of the ladder and such members are in opposed relationship to each other. As illustrated, the hook members are facing each other and the clamp applies a pulling force; however, it is contemplated that the members 27 could face away from each other and the frame could apply a pushing force to lock the frame to the rungs.

An elongated tubular member or pipe 28 is welded or otherwise secured to the rear portion of the articulated frame 26 generally along the longitudinal axis thereof and such tubular member extends beyond both ends of the frame. The forward portion of the articulated frame has a sleeve 29 which slidably receives the tubular member 28 and permits such forward portion to move relative to the rear portion so that such frame can be removably mounted on the aerial ladder. The lower or inner end of the tubular member 28 is connected to one end of a flexible fire hose 30 which normally is constructed of rubberized reinforced canvas or the like. Such fire hose is of a length to extend the full length of the aerial ladder when the ladder is extended and the other end of the hose is adapted to be connected to a water pump on the truck. When the apparatus is not in use and the ladder is retracted, the hose 30 normally is disconnected from the pump and is faked or placed in elongated back-and-forth loops on the upper section 14 of the ladder in a manner such that it can be removed easily when necessary or when the ladder is extended.

The outer end of the tubular member 28 terminates in a cross pipe or T 31 having a watertight swivel connection 32 at each end. A conventional Y-shaped yoke 33 is swingably attached to opposite ends of the cross pipe 31 by the connections 32 so that the discharge end of the yoke can swing or move up and down in a vertical plane along the longitudinal axis of the tubular member 28 as clearly seen in FIG. 3. The discharge end of the yoke 33 is connected to an adjustable nozzle 34 in a manner which will be described later.

In order to swing the yoke 32 in a generally vertical plane to direct the water passing through the nozzle 34 to a selected area, a pair of support members 37 are mounted in any convenient position on the forward portion of the articulated frame 26 and, as shown in the drawings, such support members are welded or otherwise attached to the sleeve 29. A fluid cylinder 39 is swingably mounted by pivots 38 to each of the support members 37 and each cylinder has a piston rod 40 the outer end of which is pivotally connected to a lug 41 carried by the yoke 33. Extension and retraction of the piston rods 40 causes the discharge end of the yoke 33 to swing about the connections 32.

Normally it is desirable to fight fires with a fog or mist spray since a fog cools the area surrounding the fire to a point below the kindling temperature of the material which is burning. However, the heat generated by the fire normally prevents close approach and therefore it is necessary to adjust the nozzle to discharge a steady stream of water which is under sufficient pressure to cause the water to be projected a substantial distance from the nozzle at least until the temperature of the fire has been reduced enough to permit closer approach. Accordingly, most fire fighting nozzles are adjusted when fighting a fire to attain the best compromise of distance carrying ability and cooling ability.

Normally conventional fire nozzles 34 have a fixed portion 42 which is connected to one end to the yoke 33 and a movable portion 43 with an aperture (not shown) in the outer end thereof. Such movable portion 43 is moved toward and away from a solid core member (not shown) carried by the fixed portion 42 to control the intensity of the water being discharged by regulating the proximity of the opening to the solid core. In order to control the movement of the movabe nozzle portion 43, a fixed plate 44 is mounted on the fixed nozzle portion 42 and an adjusting plate 45 is mounted on the movable nozzle portion 43. A pair of fluid cylinders 46 are carried by the fixed plate 44 on opposite sides of the fixed portion 42 and each of such cylinders is provided with a piston rod 47. The outer ends of the piston rods 47 are connected to the adjusting plate 45 in such a manner that the position of the movable nozzle portion 43 is controlled by the in-and-out movement of the piston rods 47 to adjust the intensity of the water being discharged.

The upper nozzle assembly 25 usually is mounted on top of the upper section 14 of the aerial ladder so as not to interfere with the telescoping operation of such ladder. However, as illustrated best in FIG. 4, such upper nozzle assembly is relatively narrow so that a fireman can easily straddle the same when necessary, such as during rescue operations. Also most fire trucks are equipped with stretchers or baskets for removing injured people from a building and such stretchers normally have a pair of spaced skids which support the stretcher when the stretcher is not being carried. The nozzle assembly 25 is sufficiently narrow and sufficiently low that the stretcher can slide down the ladder with the skids on opposite sides of the nozzle assembly so that the nozzle does not interfere with rescue operations.

With particular reference to FIGS. 2 and 5–7, a lower nozzle assembly 50 is mounted on the outer end of the lower section 12 of the aerial ladder by means of an articulated frame 51 similar to the frame 26 described in connection with the upper nozzle assembly 25. Each portion of the articulated frame 51 includes a pair of opposed hook members 52 adapted to be mounted on the rungs 21 of the ladder. The lower nozzle assembly 50 usually is mounted beneath the lower section 12 of the ladder so as not to interfere with the telescoping operation of the ladder. An elongated tubular member 53 is welded or otherwise secured to the rear portion of the articulated frame 51 and the forward portion of the frame has a sleeve 54 which slidably receives and supports the forward portion of the tubular member 53. Since the lower section 12 of the ladder is not extended and retracted relative to the base member 17, the lower or inner end of the tubular member 53 can be connected to a relatively strong lightweight rigid pipe 55 mounted below the lower section 12. The opposite end of the pipe 55 is connected to a water pump or the like in any desired manner, as by a swivel connection or a flexible connection (not shown).

The outer end of the tubular member 53 terminates in a hollow generally U-shaped housing 56 forming a portion of a universal type connection. The outer ends of the arms of the U-shaped housing 56 are provided with water-tight swivel connections 57 which receive one end of each of a pair of connector pipes 58. The opposite ends of the connector pipes 58 are welded or otherwise connected to the bight portion of a U-shaped housing 59 and provide communication between the housings 56 and 59. The ends of the arms of the housing 59 are provided with water-tight swivel connections 60 which swingably receive a T-shaped pipe 61 having an adjustable nozzle 62 mounted thereon.

The outer portion of the lower nozzle assembly 50 is adapted to be swung up and down along the plane of the ladder as well as from side to side of such plane and the nozzle 62 is adapted to be adjusted so that the intensity of the water being discharged can be controlled from a concentrated stream to a fog or mist. In order to move the lower nozzle assembly up and down in the vertical plane of the ladder, a yoke 63 is welded or otherwise attached to the lower portion of the sleeve 54 and such yoke is connected by a pivot 64 to a fluid cylinder 65 having a piston rod 66. The outer end of the piston rod is pivotally connected to the U-shaped housing 59 so that extension and retraction of the piston rod 66 causes the housing 59 to swing about the swivel connections 57 of the housing 56.

In order to swing the outer portion of the lower nozzle assembly 50 from side to side so that the lower nozzle 62 can be directed to a different portion of the fire from the upper nozzle, a relatively small double-acting fluid cylinder 70 is mounted on the front of the bight portion of the U-shaped housing 59 and such cylinder has a piston rod 71 which extends outwardly from each end. One end of the piston rod 71 is connected to one end of a flexible cable 72 and the other end of such cable is welded or otherwise fixed to the side of the T-shaped pipe 61 which is opposite the first end of the cable. The other end of the piston rod 71 is connected to one end of a flexible cable 73 and the other end of such cable is welded or otherwise secured to the other side of the T-shaped pipe 6. As illustrated best in FIG. 7, the cables 72 and 73 are connected to opposite ends of the piston rod 71 and cross each other before being attached to the pipe 61. When the piston rod is moved in either direction, the cable attached to the outwardly moving end of the piston rod applies a pulling force to the pipe 61 while the other cable is provided with an equal amount of slack.

In order to adjust the nozzle 62 to vary the intensity of the water being discharged from the lower nozzle assembly, the nozzle 62 has a fixed portion 74 with a plate 75 attached thereto and a movable portion 76 with a plate 77 mounted thereon. A pair of fluid cylinders 78 are carried by the fixed plate 75 on opposite sides of the fixed portion 74 and each of such fluid cylinders is provided with a piston rod 79. The outer ends of the piston rods 79 are connected to the plate 77 of the movable portion of the nozzle so that extension and retraction of the piston rods 79 moves the movable portion 76 relative to the fixed portion 74.

Figure 8:
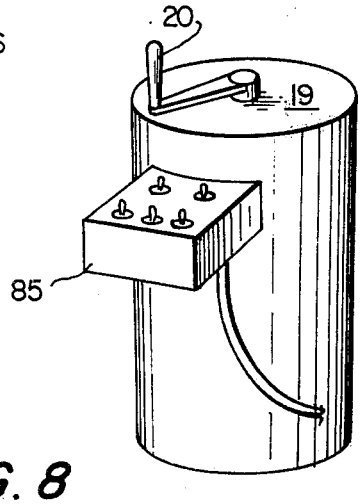
FIG. 8 is a perspective of the control pedestal of the aerial ladder.
Figure 9:
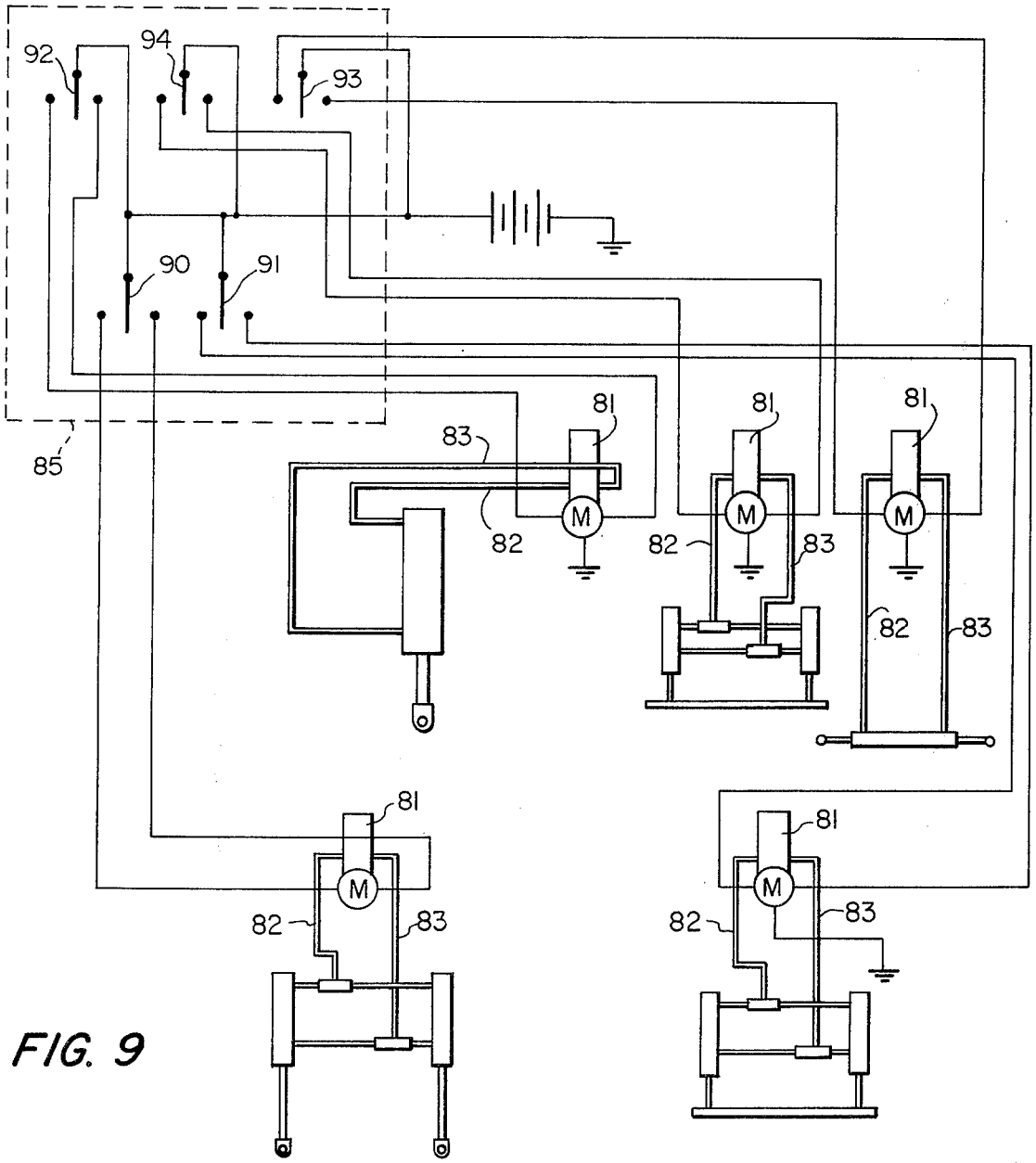
FIG. 9 is a schematic diagram illustrating the fluid and electrical systems of the apparatus.

With particular reference to FIGS. 8 and 9, the upper and lower nozzle assemblies 25 and 50 are adapted to be selectively operated from a remote position. To do this one or more housings 80 are located adjacent to the upper and lower tubular members 28 and 53, respectively, and each of such housings includes at least one reversible electrically operated fluid motor 81. Each fluid motor is connected by a first supply pipe 82 to one end of its associated fluid cylinder or cylinders for causing the piston rod thereof to be extended and a second supply pipe 83 for causing the piston rods to be retracted.

The fluid motors 81 of the upper nozzle assembly 25 are connected by wiring carried within a flexible conduit 84 to a control panel 85 mounted on the pedestal 19. As illustrated in FIG. 2, since the upper and intermediate sections 14 and 13 of the ladder are movable relative to the lower section 12, the conduit 84 extends from the upper housing 80 underneath the rungs 21 and around a spring biased pulley 86 at the inner end of the intermediate section. From the pulley 86, the conduit extends outwardly around a pulley 87 mounted on the outer end of the lower section 12 and then inwardly to the pedestal 19 where it is connected to the control panel 85. The fluid motors 81 of the lower nozzle assembly 50 are connected to the control panel 85 by wiring carried within a portion of the conduit or may be carried by a separate conduit (not shown).

The control panel 85 (FIGS. 8 and 9) includes a plurality of 3 position electrical switches for operating the individual fluid motors carried by the nozzle assemblies 25 and 50. The middle position of each of the switches is a neutral inoperative position, while the "up" position operates the associated fluid motor in one direction to extend the piston rods, while the "down" position operates the fluid motors in the reverse direction to retract the piston rods. The first switch 90 operates the fluid motor controlling the cylinders 39 for swinging movement of the upper nozzle, while the second switch 91 operates the fluid motor associated with the fluid cylinders 46 for controlling the intensity of the nozzle 34. The third switch 92 controls the fluid motor associated with the cylinder 65 for swinging the outer portion of the lower nozzle assembly 50 in a generally vertical plane, while the fourth switch 93 controls the fluid motor associated with the fluid cylinder 70 for swinging the movable portion of the lower nozzle assembly from side to side. The fifth switch 94 controls the fluid motor associated with the cylinders 78 for adjusting the intensity of the lower nozzle 62.

If desired, each of the housing 80 can be provided with a three-position switch corresponding to the switches 90–94 and connected in series with the associated switch so that the various functions of each of the upper and lower nozzle assemblies can be controlled by firemen located on the aerial ladder adjacent to such nozzle assemblies. The reason for the auxiliary switches is that occasionally a portion of the fire is blocked from the view of the firemen at the pedestal, whereas a fireman located adjacent to the nozzle assemblies has a better view and can more accurately direct the flow of water onto the fire. In this connection a communications system (not shown) is provided between the upper nozzle assembly 25 and the fireman operating the pedestal 19 so that the fireman at the outer end of the ladder can direct the fireman at the pedestal in the proper positioning of the upper nozzle assembly.

In the operation of the device, when the fire truck 10 arrives at the scene of a fire, a fireman positions himself on the rotatable base member 17 and operates the levers 20 on the pedestal 19 to raise the aerial ladder 11, extend the intermediate and upper sections 13 and 14 and rotate the base member 17 so that the aerial ladder is located in a desired position and attitude. While the fireman is manipulating the aerial ladder, other firemen are connecting the hose 30 of the upper nozzle assembly to a water pump of the truck as well as connecting the lower end of the pipe 55 to a water pump if such pipe is not connected by a permanent connection. When the water pumps are operated, the fireman at the pedestal 19 operates switches 90–94 on the control panel 85 to control the positions of the upper and lower nozzles 34 and 62, as well as the intensity of the water being discharged from each of the nozzles. By operating the switches on the control panel, the nozzles can be directed toward different portions of the fire.

In the event rescue operations are necessary, particularly in areas where the upper portion of the aerial ladder is subjected to intense heat from the fire, the fourth switch 93 is operated to cause the fluid cylinder 70 of the lower nozzle assembly to be operated so that the lower nozzle 62 is generally in alignment with the ladder 11 and the third switch 92 is operated to raise the outer portion of the lower nozzle assembly so that the nozzle 62 is located adjacent to the intermediate section 13 of the ladder. Thereafter the fifth switch 94 is operated to move the movable portion 76 of the nozzle toward the fixed portion 74 so that a fog or mist is discharged from the nozzle. Water being discharged from the lower nozzle assembly passes upwardly through the ladder to protect the fireman who must climb the ladder in order to make the rescue operation and additionally protects the fireman and the person trapped in a burning building when the fireman makes his descent with or without a stretcher.

After the rescue operations have been completed, or when no rescue operation is necessary, the aerial ladder can be lowered so that the nozzle assemblies are positioned closer to a fire than would be possible for a fireman due to the heat and therefore the nozzles can be adjusted to a fog position sooner which reduces the temperature of the fire more rapidly and, accordingly, the fire can be extinguished in a shorter period of time.

We claim:

1. A fire fighting system mounted on relatively movable sections of an aerial ladder of a fire truck and comprising a first nozzle means mounted on one section of the ladder and a second nozzle means mounted on another section of the ladder, said first nozzle means including a first frame mounted on said one ladder section, a first elongated tubular member carried by said first frame, means for supplying water under pressure to one end of said first tubular member, a first nozzle mounting means movably connected to the other end of said first tubular member, first remotely controlled fluid operating means for moving said first nozzle mounting means in at least one direction, a first adjustable nozzle carried by said first nozzle mounting means for discharging water under pressure, second remotely controlled fluid operating means for adjusting said first nozzle to vary the intensity of the water being discharged, said second nozzle means including a second frame mounted on the other ladder section in spaced relationship to said first nozzle means, a second elongated tubular member carried by said second frame, means for supplying water under pressure to one end of said second tubular member, a second nozzle mounting means movably connected to the other end of said second tubular member, third remotely controlled fluid operated means for moving said second nozzle mounting means in at least one direction, a second adjustable nozzle carried by said second nozzle mounting means for discharging water under pressure, fourth remotely controlled fluid operating means for adjusting said second nozzle to vary the intensity of the water being discharged, whereby said first nozzle mounting means may be adjusted from a remote position to direct the water being discharged from said first nozzle to a first portion of a fire and said second nozzle mounting means may be adjusted from a remote position to direct the water being discharged from said second nozzle to another portion of the fire.

2. The structure of claim 1 in which said first nozzle mounting means includes a yoke movably mounted on the other end of said first tubular member and said first remotely controlled fluid operated means includes at least one fluid cylinder mounted on said first frame and having piston rod means connected to said yoke for moving the same.

3. The structure of claim 1 in which said second nozzle mounting means includes a housing movably mounted on the other end of said second tubular member, said third remotely controlled fluid operated means including at least one fluid cylinder carried by said second frame and having piston rod means connected to said housing for moving the same relative to said second tubular member.

4. The structure of claim 3 including a hollow member movably mounted on said housing, fifth remotely controlled fluid operated means carried by said housing and connected to said hollow member for moving said member relative to said housing, and said second nozzle being mounted on said hollow member.

5. A remotely controlled fire fighting apparatus for use with a conventional aerial ladder having a plurality of spaced rungs and being mounted for selective movement on a fire truck, said apparatus comprising an articulated frame having first and second portions, each of said frame portions having hook means for selectively engaging spaced rungs of the aerial ladder, an elongated tubular member fixed to said first frame portion and extending outwardly beyond said second frame portion, means for slidably connecting said second frame portion to said tubular member, means for supplying water under pressure to one end of said tubular member, nozzle support means swingably mounted on the other end of said tubular member, said nozzle support means being swingable generally along a vertical plane, first fluid cylinder means mounted on said frame and having piston rod means connected to said nozzle support means for moving said nozzle support means along said vertical plane, an adjustable nozzle having a fixed portion connected to said nozzle support means and a movable portion slidably connected to said fixed portion, second fluid cylinder means carried by said fixed nozzle portion and connected to said movable portion of said nozzle for selectively causing relative movement therebetween to regulate the intensity of the water being discharged, a housing mounted on said frame, a first electrically operated fluid motor carried within said housing for supplying fluid under pressure to said first cylinder means, a second electrically operated fluid motor carried within said housing for supplying fluid under pressure to said second cylinder means, electrical conduits connecting said first and second fluid motors to a source of electrical energy located in a remote position, and switch means at the remote position for controlling the operation of said fluid motors, whereby the ladder is moved to a selected position in which said apparatus is adjacent to a fire and said apparatus is operated from a remote location to direct water under pressure onto the fire.

6. The structure of claim 5 in which said nozzle support means includes a hollow rotatable member to which the fixed portion of said adjustable nozzle is connected, third fluid cylinder means mounted on said nozzle support means and connected to said rotatable member for causing selective rotation thereof, a third electrically operated fluid motor carried within said housing for supplying fluid under pressure to said third cylinder means, a third electrical conduit connecting said third fluid motor to a source of electrical energy located in said remote position, and switch means at the remote position for controlling the operation of said third fluid motor.

* * * * *